US005122005A

United States Patent [19]

Kamei

[11] Patent Number: 5,122,005

[45] Date of Patent: Jun. 16, 1992

[54] PRINTER

[75] Inventor: Yuichi Kamei, Tokyo, Japan

[73] Assignee: Citizen Watch Co., Ltd., Tokyo, Japan

[21] Appl. No.: 613,726

[22] PCT Filed: Apr. 7, 1990

[86] PCT No.: PCT/JP90/00474

§ 371 Date: Nov. 29, 1990

§ 102(e) Date: Nov. 29, 1990

[30] Foreign Application Priority Data

Apr. 7, 1989 [JP] Japan ..... 1-40591

[51] Int. Cl.[5] ..... B41J 29/02

[52] U.S. Cl. ..... 400/691; 400/692; 400/693; 400/690.4

[58] Field of Search ..... 400/692, 693, 691, 690.4, 400/70, 61, 76, 171, 66; 346/145; 365/52, 63; 307/154

[56] References Cited

U.S. PATENT DOCUMENTS 4,527,285 7/1985 Kekas ..... 455/607
4,826,332 5/1989 Ukai ..... 400/70

FOREIGN PATENT DOCUMENTS 110632 6/1984 European Pat. Off. ..... 400/692
3005269 8/1981 Fed. Rep. of Germany ..... 365/52
222763 10/1986 Japan ..... 400/692
263077 11/1987 Japan ..... 400/692

OTHER PUBLICATIONS

IBM Tech. Disclosure Bulletin, vol. 30, No. 11, Apr. 1980 "Connector Cartridge for Logic Card Packages".
US PTO Translation 90-3055 of Japanese Kokai Patent Sho 61-222763 (1986).

*Primary Examiner*—Edgar S. Burr
*Assistant Examiner*—Eric P. Raciti
*Attorney, Agent, or Firm*—Lowe, Price, LeBlanc & Becker

[57] ABSTRACT

A printer which is permitted to be mounted with an interface unit for connecting the printer to a computer, without the need of removing a printer case. A unit accommodating space (13) arranged to receive an extension interface unit and an integrated circuit card (50) is formed in the printer case (10) which is provided with a first connector (30) connected to a standard interface unit accommodated in the printer. The accommodating space defined by partition walls (14–17) is isolated from printer constituent parts, such as a controller printed-circuit board, disposed within the printer case. A second connector (41) and a socket (51) respectively arranged to be mounted with the extension interface unit and the integrated circuit card are disposed to be exposed to the unit accommodating space, whereby the extension interface unit and the integrated circuit card can be easily mounted to the printer, without the need of removing the printer case and without being brough into contact with the printer constituent parts.

9 Claims, 2 Drawing Sheets

PRINTER

TECHNICAL FIELD

The present invention relates to a printer, and more particularly, to a printer which permits an interface unit for connecting the printer to an information processing device to be easily mounted, without the need of removing a printer case.

BACKGROUND ART

In general, a printer is used as an output terminal instrument for an information processing device (hereinafter referred as computer) such as a computer or the like, and is provided with an interface unit (hereinafter referred to as I/F unit) for connecting the printer to the computer. Since there is a variety of computers having different arrangements, the I/F unit mounted on the printer is generally arranged to be compatible for use in a computer of that kind which is normally connected to the printer. To permit the printer to be connected, where required, with another kind of computer, it has been known to provide the printer with a connector for connecting an optional extension I/F unit to the printer. Typically, a conventional connector for the extension I/F unit connection is accommodated in a printer case together with a control printed-circuit board. In this respect, when the extension I/F unit is mounted to the printer, the printer case must be removed from the printer body by the use of tools. This causes inconveniences.

To eliminate such disadvantage, it has been known to permit the extension I/F unit to be mounted, through an opening provided in the printer case, to the connector disposed within the interior of the printer case. However, a considerable difficulty is encountered in mounting the extension I/F unit to the connector through the opening of the printer case. Moreover, printer constituent parts such as electric circuit components disposed within the printer case can be damaged, if the extension I/F unit is brought in contact with the printer parts during the mounting operation.

In this regard, it has been known to form the extension I/F unit into cassette type or cartridge type (see, Japanese Utility Model Provisional Publication Nos. 62-33459, 62-41558 and 62-128845, for instance), so as to permit the extension I/F unit to be mounted without the need of removing the printer case from the printer body. According to this kind of printer, however, the printer case must be arranged to be compatible for use with the extension I/F unit of cassette type or cartridge type. Hence, the printer case must be designed to have a special arrangement suited to the type of the extension I/F unit to be used. This decreases the versatility of the printer case and increases the cost of the printer case.

DISCLOSURE OF THE INVENTION

It is an object of the present invention to provide a printer, which is capable of easily mounting an interface unit for connecting the printer to a computer, without the need of removing a printer case, and which is low-priced.

In order to achieve the aforementioned object, a printer of the present invention comprises a connector which is connected to a control printed-circuit board disposed within a printer case, and an interface unit which is arranged to be detachably mounted to the connector. The printer case is provided with partition walls defining a unit accommodating space which is arranged to receive the interface unit, and which is isolated by the partition walls from printer constituent parts disposed within the printer case. The connector has a side to which the interface unit is mounted and which is exposed to the unit accommodating space defined by the partition walls.

As described above, according to the present invention, since the connector has a side to which the interface unit is mounted and which is exposed to the unit accommodating space defined by the partition walls of the printer case, it is possible to easily mount the interface unit to the connector. This makes it possible to easily connect the interface unit through the connector to the control printed-circuit board disposed within the printer case. In addition, since the unit accommodating space for receiving the interface unit is isolated by the partition walls from the printer constituent parts disposed in the printer case, it is possible to prevent the interface unit from being inadvertently contacted with the printer constituent parts during an operation of mounting the interface unit to the connector. This makes it possible to positively prevent damages to the printer constituent parts during the mounting operation of the interface unit. Moreover, in order to mount the interface unit, it is enough for the printer case to be formed at a part thereof with the unit accommodating space. Thus, modifications of the printer case in its specifications can be minimized, making it possible to reduce the cost.

BEST MODE OF CARRYING OUT THE INVENTION

Figure 1:
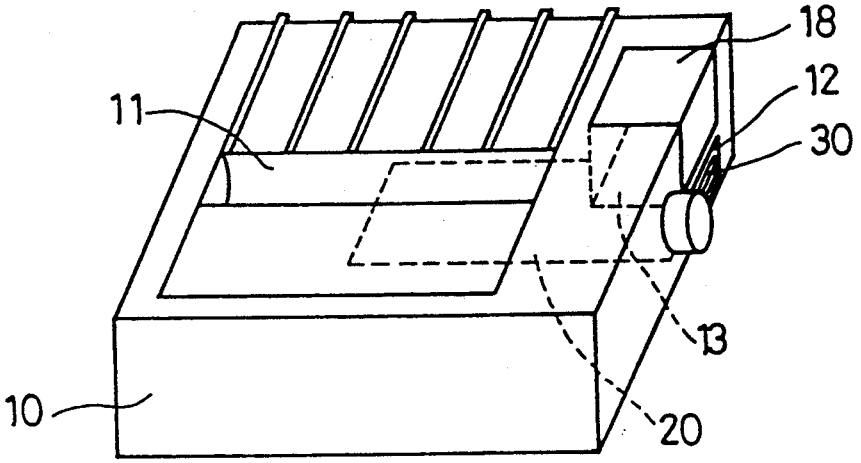
FIG. 1 is a schematic perspective view showing a printer according to an embodiment of the present invention.

Referring to FIG. 1, a printer of an embodiment of the present invention, serving as an output terminal unit for use with an information processing device such as a computer, comprises a printer case 10 which is detachably fixed to a printer body (not shown). Disposed within the printer case 10 are a control printed-circuit board 20 for controlling operation of the printer, and a parallel interface unit (hereinafter referred to as standard I/F unit), not shown, mounted to the printer as a standard specification component and connected to the control printed-circuit board 20. A sheet taking-out port 11 is formed in an upper face of the printer case 10, and a recess 12 is formed in one side of a rear portion of the printer case 10. Normally received in the recess 12 is a first connector 30 of female type for connecting the standard I/F unit with a computer (not shown) employed in combination with the printer, for example, a computer of parallel communication type. The first connector 30 has one side thereof to which the computer cable connector is mounted and which is exposed to the outer face of the printer case 10, and the other side thereof connected to the standard I/F unit. Further, the printer case 10 is formed with a sheet supply port (not shown).

Figure 2:
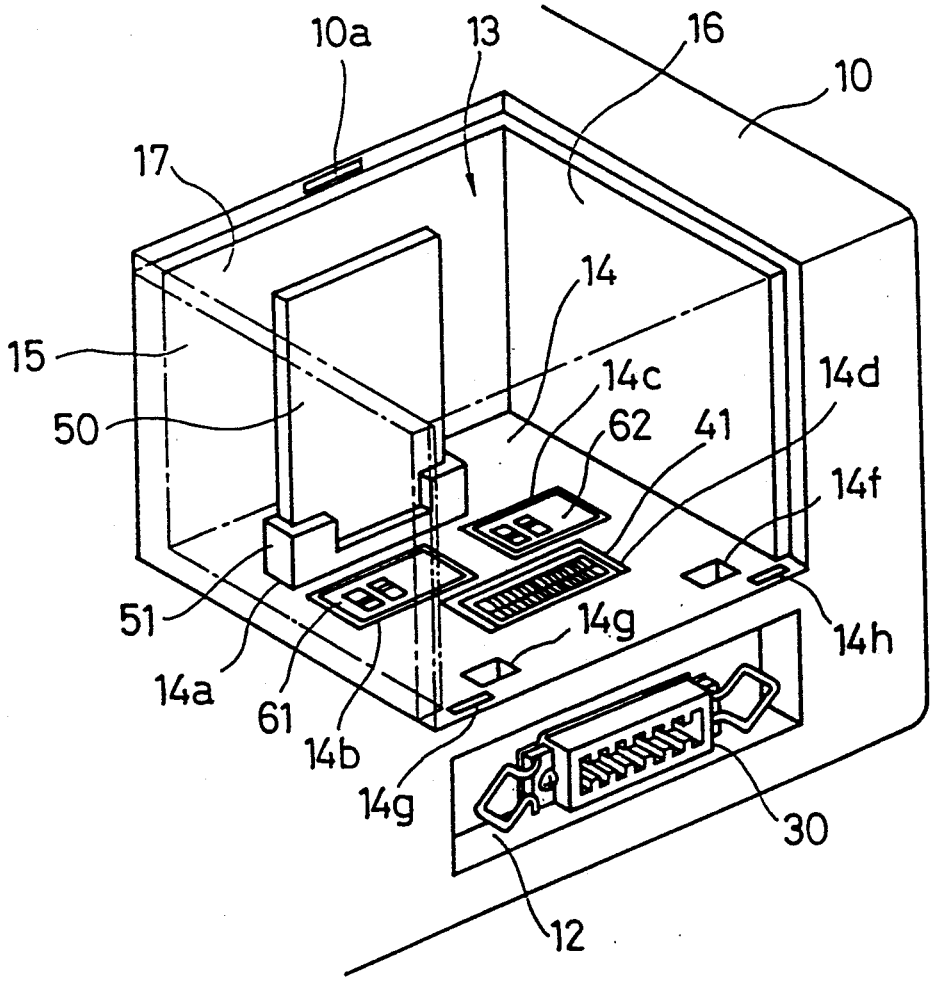
FIG. 2 is a fragmentary enlarged perspective view showing a principal part of the printer of FIG. 1, with an extension I/F unit removed.
Figure 3:
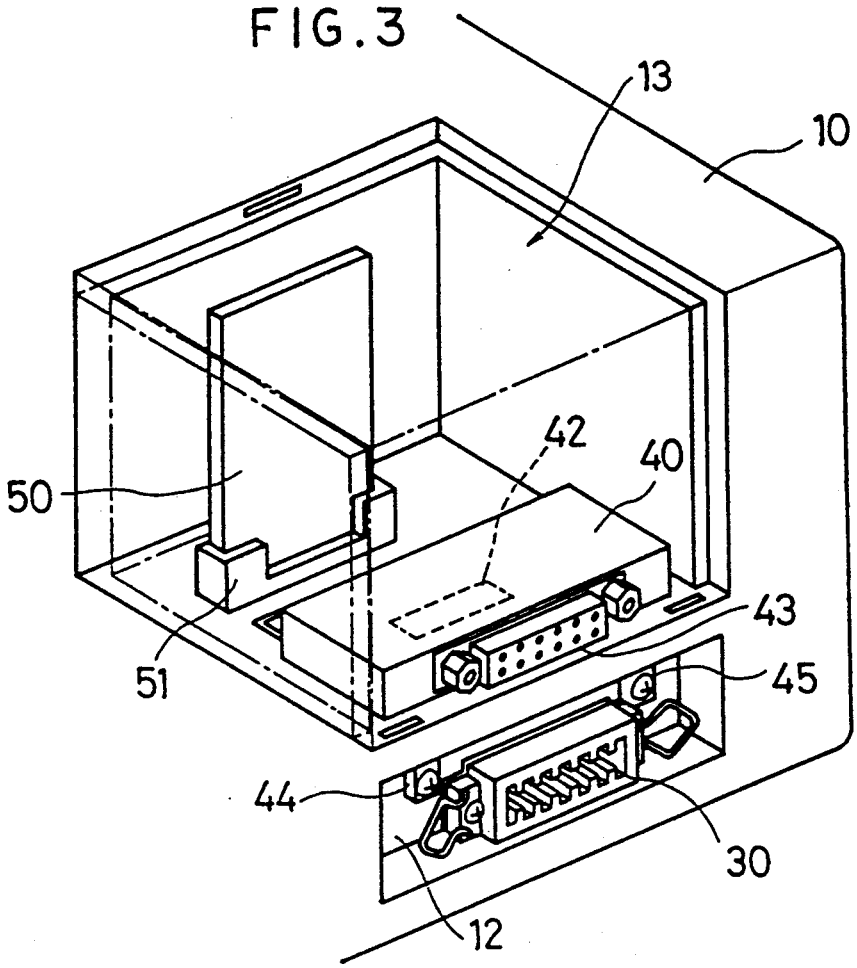
FIG. 3 is a view, similar to FIG. 2, showing a state where the extension I/F unit is mounted.

A unit accommodating space (recess) 13 in the form of a cube is formed above the recess 12 in the printer case 10. As shown in FIGS. 2 and 3, the unit accommodating space 13 is defined by four partition walls 14, 15, 16 and 17 which form part of the printer case 10. The unit accommodating space 13 is so arranged as to receive an optional serial interface unit (hereinafter referred to as extension I/F unit) 40 for connecting the printer with a computer of type different from the parallel communication type, e.g., a computer (not shown) of serial communication type, and an IC (integrated circuit) card 50 cooperating with the extension I/F unit 40 to form a function extension unit for extending functions of the printer.

More specifically, the four partition walls of the printer case 10 include a bottom wall 14, which extends horizonatally from the outer face of the printer case 10 toward the interior of the printer at a location above the recess 12 of the printer case 10 and which corresponds to the bottom of the unit accommodating space 13, and a front wall 15, a rear wall 16 and an inner wall 17 which respectively extend vertically of the printer from the upper face of the printer case 10 toward the bottom wall 14. The front wall 15 and the rear wall 16 are disposed in parallel to each other, and the inner wall 17 is disposed in parallel to the side face of the printer case 10. These partition walls 14 through 17 are formed integrally with each other and with the printer case 10.

The bottom wall 14 is formed with various bores which are employed for mounting various parts. Namely, a bore **14*a* for receiving a socket 51 arranged to be detachably mounted with the IC card 50, is formed through the bottom wall 14. Further formed through the bottom wall 14 are bores 14*b* and 14*c* for respectively accommodating therein dip switches 61 and 62, and a bore 14*d* for accommodating therein a female second connector 41 which is arranged to be detachably mounted with the extension I/F unit 40. The side of the socket 51 to which the IC card is mounted, the upper faces of the dip switches 61 and 62, and the side of the second connector 41 to which the extension I/F unit is mounted are disposed to be exposed to the unit accommodating space 13 or to project thereinto. Thus, the elements 41, 51, 61 and 62 are easily accessible from one side of the printer case 10 through the unit accommodating space 13. The other side of the socket 51 and the other side of the second connector 41 are connected to the control printed-circuit board 20. See FIG. 1. Reference numeral 42 in FIG. 3 denotes a male connector which is provided at the bottom face of the extension I/F unit 40 so as to be connectable to the second connector 41; and 43, a female connector which is provided at the outer face of the extension I/F unit 40 so as to be connectable to a male computer cable connector (not shown). Further, a pair of bores 14*g* and 14*h*, respectively extending through a pair of mounting legs 44 and 45 of the extension I/F unit 40, are formed through the bottom wall 14**.

Figure 4:
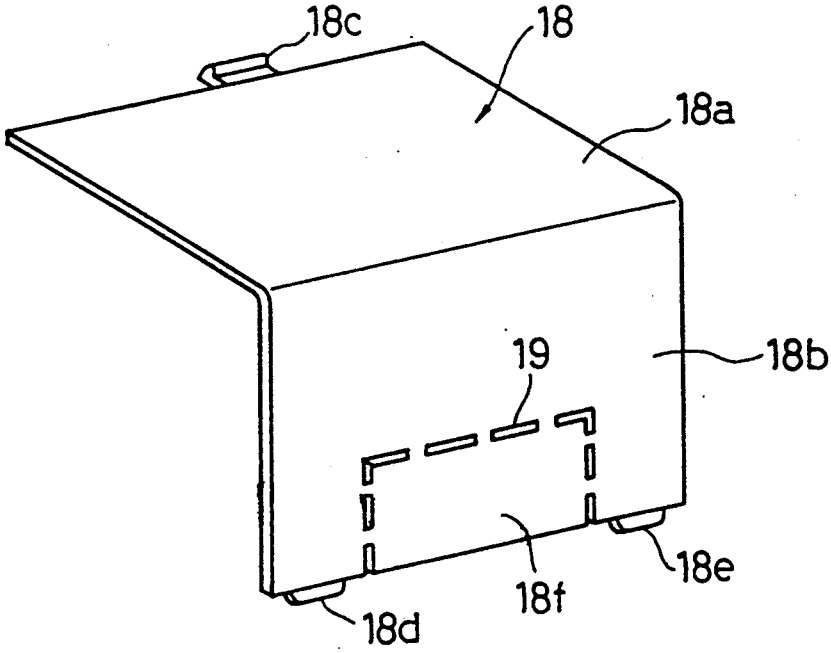
FIG. 4 is an enlarged perspective view showing a cover of FIG. 1.

As shown in FIG. 4, a cover 18 for covering the unit accommodating space 13 is composed of an upper wall **18*a* and a side wall 18*b*, and is arranged to be detachably mounted to the unit accommodating space formed portion of the printer case 10. The cover 18 has three pawls 18*c* to 18*e* respectively provided at the upper wall 18*a* and the side wall 18*b* which are fitted in bores 10*a*, 14*g* and 14*h* respectively formed in the printer case 10 and the bottom wall 14 at the time of mounting the cover to the printer case 10. Upper edges of the front, rear and inner walls 15 to 17 and outer edges of the front and rear walls are formed with steps which are equal in size to a thickness of the cover. Upon mounting of the cover, both side edges and a forward edge of the cover are respectively fitted in these steps, so that the cover 18 is flush with the printer case 10. Further, the cover side wall 18*b* is formed with a series of perforations 19 which permit a cover piece 18*f*, forming a part of the cover side wall, to be easily removed, if necessary, so that a cutout (not shown) permitting access to the connector 43 of the extension I/F unit 40 is formed in the cover 18 when the cover piece 18** is removed.

In order to mount the extension I/F unit 40 and the IC card 50 to the printer constructed as mentioned above, at first, the cover 18 is removed from the printer case 10 so as to allow access, through the unit accommodating space 13, to the second connector 41 and the socket 51 which are respectively provided at the bottom wall 14 of the printer case 10. Subsequently, the IC card 50 is inserted into the socket 51 and is mounted to the printer. As best seen in FIG. 3, the unit accommodating space 13 is shaped and sized such that the extension I/F unit 40 does not closely fit into and fill up the available room therein. The IC card 50 is connected through the socket 51 to the control printed-circuit board 20 disposed within the printer case 10. Whereupon, the mounting legs 44 and 45 of the extension I/F unit 40 are respectively inserted in the bores **14*e* and 14*f*, and the male connector 42 provided at the bottom face of the unit 40 is inserted in the second female connector 41. Then, the mounting legs 44 and 45 are fixed to the printer case 10 by means of screws, to thereby complete mounting of the extension I/F unit 40. The unit 40 is connected to the control printed-circuit board 20 through the second connector 41**.

At the time of mounting the extension I/F unit 40 and the IC card 50, it is unnecessary to dismount the printer case 10 from the printer body because the socket 51 and the second connector 41 to which both the elements 40 and 50 are to be mounted are rendered accessible by simply removing the cover 18 from the printer case 10. Further, the unit accommodating space 13, and hence the extension I/F unit 40 and the IC card 50 are isolated from the printer constituent parts disposed within the printer case 10, such as the control printed-circuit board 20, by the partition walls 14 to 17 of the printer case 10, particularly by the bottom wall 14. As a result, during the mounting operation, there is no fear that the unit 40 and the IC card 50 are brought into contact with the printer constituent parts, whereby damages to the printer parts are prevented.

After the extension I/F unit 40 is mounted, the unit accommodating space 13 is covered by the cover 18, which is provided with the cutout by removing the cover piece **18*f* therefrom, if necessary. In case that the cover 18 is attached, a male computer cable connector (not shown) is plugged into the female connector 43 of the extension I/F unit 40 through the cutout of the cover 18**, to thereby connect the printer to the computer of serial communication type. This permits signal transfer between the printer and the computer of serial communication type.

On the other hand, in case that the printer is connected to the computer of parallel communication type, a cable connector (not shown) of the computer is plugged into the first connector 30, whereby signal transfer between the printer and the computer of parallel communication type is permitted.

The present invention is not limited to the foregoing embodiment, but various modifications thereof may be made.

For example, in the embodiment, the unit accommodating space in the form of a cube is provided on one side of the printer rear portion. However, it is enough for the unit accommodating space to accommodate therein one or more desired function extension units, and hence a spatial configuration of the unit accommodating space and a portion on the printer at which the same space is provided may be selected in various manners.

Further, in the embodiment, explanations have been given as to the printer which is provided with the built-in standard I/F unit and the unit accommodating space arranged to receive the extension I/F unit and the IC card. However, the present invention may be applied to a printer of type accommodating therein no built-in standard I/F unit. In this case, the standard I/F unit may be disposed within the unit accommodating space. Furthermore, the extension I/F unit may be of a type other than the serial I/F unit, if the same unit is suitable to the kind of the computer to be connected to the printer. That is, the printer of the present invention can be so modified as to be compatible for use with various types of computers. Moreover, the extension I/F unit may be of printed-circuit board type which is not covered by a casing. Further, the printer of the present invention may be so modified as to be mounted with a ROM cartridge, a RAM cartridge, etc., in stead of an IC card.

Although female connectors are used as the first and second connectors in the embodiment, this simply shows a typical example, and male connectors may be used instead. The same is applicable to other connectors in the embodiment. Further, the construction of the first and second connectors and other connectors can be modified in various manners, and the connector configuration, the number of pins, etc., may be so selected as to be compatible with the kind of a computer connected to the printer.

Although the unit accommodating space is covered by the cover in the embodiment, the cover is not essential. To improve external appearance of a printer provided with no cover, function extension units may be employed, which have outer dimensions and outer configurations permitting these units to be disposed in the unit accommodating space in a manner that the outer faces thereof are flush with the outer face of the printer case.

In this disclosure, there are shown and described only the preferred embodiments of the invention, but, as aforementioned, it is to be understood that the invention is capable of use in various other combinations and environments and is capable of changes or modifications within the scope of the inventive concept as expressed herein.

I claim:

1. An improved printer having a body comprising a printer case surrounding printer constituent parts, a connector for an interface unit, in which said connector is formed to be connected to control printed-circuit boards disposed within said printer case, and said connector being arranged to be detachably mounted with an interface unit, wherein the improvement comprises:

partition walls, defining a unit accommodating space in said printer case, wherein said unit accommodating space defines a volume sufficiently dimensioned to receive therein the interface unit and leaving sufficient space for an extension element;

said unit accommodating space being isolated from the printer constituent parts by said partition walls;

said connector having a connection side for receiving said interface unit, said connection side being exposed within said unit accommodating space.

2. The printer according to claim 1, wherein:

said partition walls of said printer case include a bottom wall corresponding to a bottom of said unit accommodating space, and said bottom wall is formed with a bore in which said connector is received.

3. The printer according to claim 1, wherein:

said unit accommodating space is arranged to receive said interface unit and a function extension unit other than said interface unit, and wherein a connecting component is provided and is arranged to be exposed to said unit accommodating space and to be mounted with said function extension unit other than said interface unit, said connecting component being connected to said control printed-circuit board.

4. The printer according to claim 3, wherein:

said partition walls of said printer case include a bottom wall corresponding to a bottom of said unit accommodating space, and said bottom wall is formed with a bore in which said connecting component is received.

5. The printer according to claim 3, wherein:

said function extension unit other than said interface unit is an IC card, and said connecting component is a socket.

6. The printer case according to claim 1, further including:

a cover for covering said unit accommodating space, wherein said cover is detachably mounted to cover said unit accommodating space portion of said printer case.

7. The printer according to claim 6, wherein:

said cover has a series of perforations defining an optionally removable cut-out portion.

8. The printer according to claim 7, wherein:

said unit accommodating space is arranged to receive said interface unit and a function extension unit other than said interface unit, and wherein a connecting component is provided and is arranged to be exposed to said unit accommodating space and to be mounted with said function extension unit other than said interface unit, said connecting component being connected to said control printed-circuit board.

9. The printer according to claim 8, wherein:

said partition walls of said printer case include a bottom wall corresponding to a bottom of said unit accommodating space, and said bottom wall is formed with a bore in which said connecting component is received.

* * * * *